United States Patent [19]

Sugimoto et al.

[11] Patent Number: 5,059,063

[45] Date of Patent: Oct. 22, 1991

[54] METHOD OF PROTECTING UNDERGROUND STRUCTURES IN GROUND LIABLE TO BE LIQUEFIED

[75] Inventors: Tadao Sugimoto; Shigeki Tsuchiyama, both of Nagoya; Makoto Hayakawa, Kariya; Yozo Goto, Tokyo; Tadao Koide, Sayama; Tamotsu Endoh, Yokohama; Makoto Toriihara, Iruma; Joji Ejiri, Tokyo, all of Japan

[73] Assignees: Ohbayashi Corporation, Osaka; Chubu Electric Power Company, Incorporated, Aichi, both of Japan

[21] Appl. No.: 433,206

[22] Filed: Nov. 8, 1989

[51] Int. Cl.[5] ..... E02B 11/00; E21D 9/14

[52] U.S. Cl. ..... 405/36; 52/167 R; 52/169.5

[58] Field of Search ..... 405/36, 37, 132, 137, 405/229; 52/167, 169.5

[56] References Cited

U.S. PATENT DOCUMENTS

| | | | |
|---|---|---|---|
| 2,154,233 | 4/1939 | Donaldson | 405/137 |
| 2,219,710 | 10/1940 | Litz et al. | 405/229 |
| 3,124,935 | 3/1964 | Foster | 405/36 X |
| 4,271,648 | 6/1981 | Johnson | 52/169.2 |
| 4,298,294 | 11/1981 | Zimmerman | 405/37 |
| 4,843,786 | 7/1989 | Walkinshaw et al. | 52/169.5 |

*Primary Examiner*—David H. Corbin

*Attorney, Agent, or Firm*—Wenderoth, Lind & Ponack

[57] ABSTRACT

A conglomerate layer is formed horizontally on a base of ground which has a high water permeability and easily liquefies. A bottom plate is formed on the conglomerate layer to construct the underground structure thereon. One or more drainpipes are extended upwardly from the conglomerate layer through the bottom plate for draining excessive pore water in the ground.

6 Claims, 1 Drawing Sheet

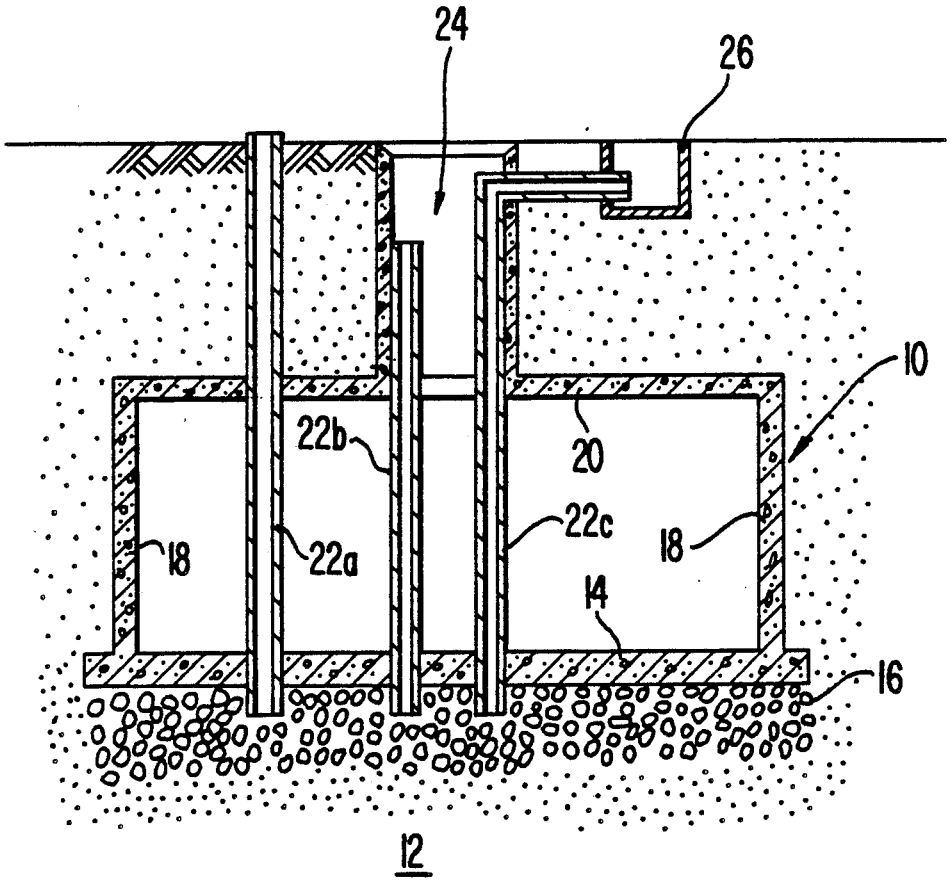
24
26
10
22b
20
22c
18
18
22a
14
16
12

METHOD OF PROTECTING UNDERGROUND STRUCTURES IN GROUND LIABLE TO BE LIQUEFIED

BACKGROUND OF THE INVENTION

1. Field of the Invention

The present invention relates to a method of protection of an underground structure in ground which has a high water permeability and easily liquefies, such as sandy ground, and particularly to a protection method which is suitable to prevent floating of the underground structure and outflow or wash out of ground from under the structure.

2. Description of the Prior Art

Generally, ground which has a high water permeability and contains excessive pore water easily liquefies when the pressure of the water is increased by an earthquake. Further, an underground structure whose interior is hollow, like an underground tunnel, generally has a small apparent specific gravity. Accordingly, such underground structure constructed in such ground in the past frequently has been floated when liquefaction of the ground was caused by earthquakes.

As a countermeasure to solve such a problem, there are known a method of improving the ground, a method of forming a gravel drain and a method of lowering of the ground-water level. However, to employ these methods, various conditions of the ground and restrictions on long term maintenance and management of the structures would be required. Thus, these methods are not frequently adopted.

It is possible to apply to such type of underground structure additional structures for preventing the ground from being in a liquefied state, e.g. as disclosed in Japanese Provisional Patent Publication No. 127823/1983. However, such additional structures inevitably are accompanied by the following problems. Namely, in such structure, a predetermined number of drain pillars are provided in the base ground to support an underground structure. The drain pillars each comprise a concrete pillar having water permeability. On the outer circumference of the concrete pillar is formed a wall having water permeability with materials such as gravel, fine stone and slag. By this arrangement, it is attempted to employ the drain pillars to prevent an increase of the pressure of excessive pore water in the ground. However, it is difficult to construct such drain pillars under the underground structure, and even if possible, such construction requires a substantially high cost. Moreover, in the above-mentioned structure where the drain pillars are formed under the underground structure, the underground structure is liable to be floated by the pressure of water which elevates in the drain pillars when the ground becomes liquefied.

3. Object of the Invention

The present invention has been accomplished in an attempt to solve the above problems of the prior art. Therefore, it is an object of the invention to provide a method of protecting an underground structure in ground which is liable to be liquefied. Moreover, the method can prevent floating of the underground structure and can be achieved by a constructional operation that can be done easily and at low cost.

SUMMARY OF THE INVENTION

The present invention is directed to a method of protecting underground structures, such as an underground tunnel, in ground which easily liquefies, comprising steps of forming a conglomerate layer horizontally on base ground which easily liquefies, forming a bottom plate on the conglomerate layer to construct an underground structure thereon, and arranging one or more drainpipes extending upwardly from the conglomerate layer through the bottom plate, thereby collecting excessive pore water in the ground in the conglomerate layer, and then draining the water to the surface of the ground or into the underground structure through the drainpipes.

According to the method of the present invention, when the pressure of excessive pore water in the ground which is liable to be liquefied, such as like sandy ground, is increased by an earthquake, the excessive pore water first is collected in the conglomerate layer, and then it is rapidly drained to the surface of the ground or into the underground structure by the drainpipes extending upwardly through the bottom plate, so that floating of the underground structure by the increase of the pressure of the water effectively can be prevented.

These and other objects, features and effects of the present invention will be more apparent from the following detailed description with reference to the accompanying drawings.

BRIEF DESCRIPTION OF THE DRAWINGS

The FIGURE is a cross section showing an underground structure constructed in ground which easily liquefies and protected by a protection method according to the present invention.

DETAILED DESCRIPTION OF THE INVENTION

In the drawing, an underground structure 10 is located at a predetermined depth in sandy ground 12 which has a high water permeability and easily liquefies. The structure 10 is formed of concrete and is hollow, such as an underground tunnel.

In the protection method of the invention, a conglomerate layer 16 having a predetermined thickness is formed under a bottom plate 14 of the structure 10 before the structure 10 is constructed. THe conglomerate layer 16 comprises conglomerate of a predetermined size spread over an area corresponding to the area of bottom plate 14 to be constructed. It is a matter of course that the conglomerate layer 16 can be formed by spreading and compacting conglomerate by usual construction methods.

After the conglomerate layer 16 is formed in the above manner, the bottom plate 14 is constructed on the layer 16, and then side walls 18 and an upper plate 20 are constructed so as to form the underground structure 10.

Moreover, during or after the construction of the structure 10, one or more hollow drainpipes *22a–22c* are provided to extend upwardly from the conglomerate layer 16. In the illustrated embodiment, three drainpipes *22a–22c* of hollow pipe shape are formed. One end of the left drainpipe *22a* in the drawing is located in the conglomerate layer 16 and the other end thereof extends to the ground surface. One end of the central drainpipe *22b* is located in the conglomerate layer 16 and the other end thereof opens to a manhole 24 extending from the upper plate 20 of the underground structure 10 to the ground surface. The height of the opening of the drainpipe 22b is set to be higher than a normal level of ground-water, and thus underground water never flows thereinto. One end of the right drainpipe 22c is located in the conglomerate layer 16 and the other end thereof opens to a catch-basin 26 formed in the ground.

In the arrangement constructed as mentioned above, when the pore water pressure in the sandy ground 12 is increased by an earthquake, excessive pore water is collected in the conglomerate layer 16, and such water is rapidly drained onto the ground surface or into the hollow underground structure 10 through the drainpipes 22a–22c. Thus, both the increase of the pore water pressure around the structure 10 and the liquefaction of the ground are suitably controlled, so that floating of the structure 10 and wash out of the base ground thereunder effectively can be prevented.

Moreover, since some of the excessive water is drained into the underground structure 10, the apparent specific gravity of the structure 10 thereby is increased, thus farther increasing the ability to prevent floating.

Additionally, since the protection method of the invention comprises only the steps of forming the conglomerate layer under the bottom plate of the underground structure and arranging one or more drainpipes extending upwardly from the conglomerate layer, the method can be realized with easy and low-cost construction of the underground structure.

What is claimed is:

1. A method of protecting an underground structure such as an underground tunnel in ground which is liable to be liquefied, said method comprising the steps of:

forming a conglomerate layer of a predetermined thickness horizontally on base ground which easily liquefies;

forming on said conglomerate layer a bottom plate on which the underground structure is constructed;

providing one or more drainpipes, each said drainpipe having opposite first and second open ends, and each said open end having an opening area substantially equal to the cross-sectional area of the respective said drainpipe; and arranging each of said one or more drainpipes such that said first open end thereof is positioned within said conglomerate layer, said second open end thereof communicates with one of the surface of the ground or the interior of the underground structure, and said drainpipe extends upwardly from said first open end thereof, through said bottom plate, to said second open end thereof;

whereby excessive pore water in the ground first is collected in said conglomerate layer, flows through said first open end of each said drainpipe and discharge through said second open end thereof to the surface of the ground or into said interior of said underground structure.

2. A method of protecting an underground structure according to claim 1, wherein said forming of said conglomerate layer comprises spreading and compacting conglomerate.

3. A method of protecting an underground structure according to claim 1, comprising forming said conglomerate layer over an area corresponding to the entire area of said bottom plate.

4. A method of protecting an underground structure according to the claim 1, comprising arranging at least one of said drainpipes to extend to the ground surface through an upper plate of said underground structure.

5. A method of protecting an underground structure according to claim 1, comprising arranging at least one of said drainpipes to extend through an upper plate of said underground structure and to open into a manhole formed from said upper plate to the ground surface.

6. A method of protecting an underground structure according to claim 1, comprising arranging at least one of the drainpipes to extend through an upper plate of said underground structure and to open into a catch-basin formed in the ground.

* * * * *